United States Patent [19]

Gertzfeld

[11] Patent Number: 4,891,030

[45] Date of Patent: Jan. 2, 1990

[54] TOY WITH LIGHTED PLAYPIECES

[75] Inventor: Sheldon G. Gertzfeld, Northbrook, Ill.

[73] Assignee: Superior Toy & Manufacturing Company, Inc., Chicago, Ill.

[21] Appl. No.: 187,424

[22] Filed: Apr. 28, 1988

[51] Int. Cl.[4] ..... A63H 33/04

[52] U.S. Cl. ..... 446/118; 446/124; 446/485

[58] Field of Search ..... 446/91, 118, 219, 484, 446/485, 124, 125; 40/541, 542, 552, 563

[56] References Cited

U.S. PATENT DOCUMENTS

| | | | |
|---|---|---|---|
| 3,237,341 | 3/1966 | Janning | 446/91 |
| 3,530,615 | 9/1970 | Meyer | 446/91 |
| 3,568,357 | 3/1971 | Lebensfeld | 446/118 X |
| 3,589,056 | 6/1971 | Glass | 446/118 X |
| 3,634,678 | 1/1972 | Glass | 446/91 X |
| 3,696,548 | 10/1972 | Teller | 446/91 |
| 4,196,539 | 4/1980 | Speers | 446/118 X |
| 4,541,812 | 9/1985 | Katsumata | 446/485 X |

FOREIGN PATENT DOCUMENTS

| | | | |
|---|---|---|---|
| 3146247 | 6/1982 | Fed. Rep. of Germany | 446/91 |
| 1538008 | 8/1968 | France | 446/91 |

*Primary Examiner*—Robert A. Hafer
*Assistant Examiner*—Sam Rimell
*Attorney, Agent, or Firm*—Laff, Whitesel, Conte & Saret

[57] ABSTRACT

A lighted construction toy that includes a light box with a translucent top. The top includes a plurality of upstanding pegs that are arranged in a grid pattern. A plurality of blocks have sockets on their underside which may be pressed down over the pegs on the top and also over pegs on the upper side of the blocks. All blocks are shaped and dimensioned to fit together in the formation of a variety of structures.

8 Claims, 1 Drawing Sheet

TOY WITH LIGHTED PLAYPIECES

This invention relates to toys and more particularly to lighted construction toys wherein different types of structures may be formed by assembling blocks in different ways.

The word "translucent" is used herein to describe any suitable light conducting material without regard as to whether it might more appropriately be described as transparent, translucent, fluorescent, or the like.

Children enjoy games having blocks, structural members, and the like which may be assembled in many different geometrical forms, limited only by their individual creativity. Children also enjoy brightly colored toys, especially those which may be arranged and rearranged in many different creative ways. Also, children enjoy toys which have some kind of device which they may control, such as toys with a light which they may turn on.

A number of toys provide these and similar functions, but the child has already been exposed to many of them. Thus, it becomes a challenge to provide new toys which give a fresh approach that will rekindle and hold the child's interest. On the other hand, if the new toy is completely alien to the child's background, it may be too tedious for him to learn how to use it. That, in turn, may lead him to reject the toy completely. Thus, the problem for the toy designer is to provide a toy in the difficult middle ground where the toy is novel enough to attract and hold a child's attention while being familiar enough not to repel him.

Accordingly, an object of this invention is to provide new and improved toys. Here an object is to provide novel toys which are familiar enough for a child to be both interested and comfortable with it, while still providing a challenge and an attraction for him.

Another object of the invention is to provide novel toys with brightly colored playing pieces.

Still another object is to provide toys with lights which the child may control.

In keeping with an aspect of the invention, these and other objects are accomplished by a light box with a translucent upper surface having a plurality of upstanding posts arranged in a grid-like pattern thereon. Preferably, the translucent material gives the upper surface a white, milky color. Translucent block of many different colors and sizes have lower surfaces which are complementary to the grid of posts and upper surfaces which are complementary to their lower surfaces. Therefore, the blocks may be mounted on the grid and on each other, in any suitable pattern.

The invention may be understood best from a study of the following specifications and attached drawings, in which.

DETAILED DESCRIPTION OF THE INVENTION

Figure 1:
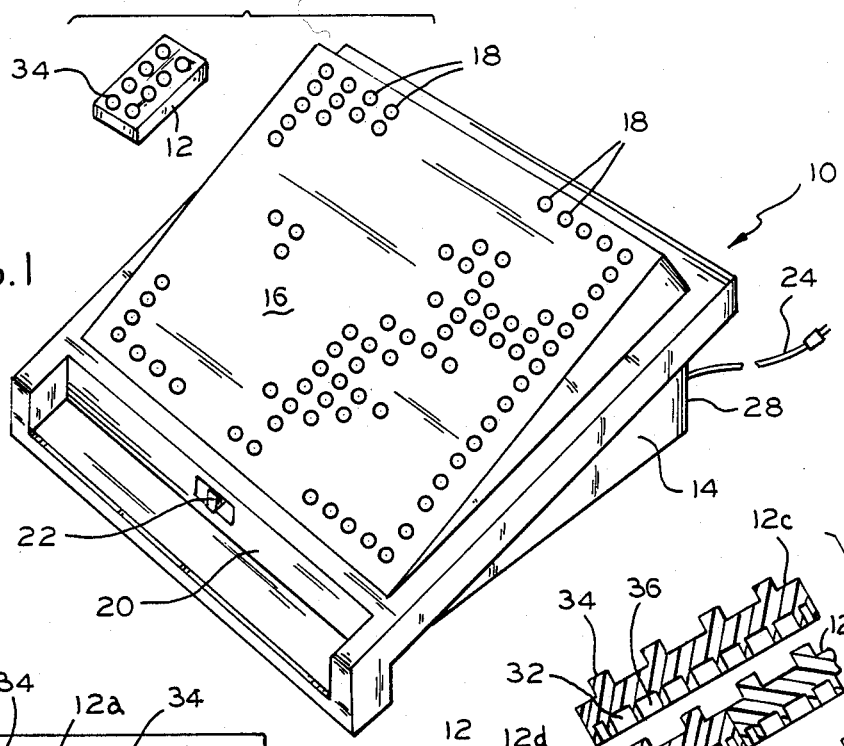
FIG. 1 is a perspective view of a single, exemplary block and a light box with a translucent top having a plurality of upstanding pegs formed thereon.

The invention provides a lighted construction toy assembly 10 (FIGS. 1–4), having, in part, a block or a plurality of translucent or transparent multi-color blocks 12, light box 14, and a translucent top 16 that includes a plurality of upstanding pegs 18 formed thereon. The pegs 18 are arranged in a grid pattern and are shaped and adapted to receive one or more of the blocks 12, when pressed down over the pegs.

The lighted construction toy has a generally square or rectangular light box 14, in plan view. The front portion of the light box 14 may have a set back "control" panel 20; or, it may be uniplanar with the light box 14 itself. Panel 20 may carry an on-off switch 22 for controlling a light source. The light box 14 has a hollow interior and is adapted to receive a light source coupled through switch 22 to a power cord 24 extending through a side or the bottom of the box.

The light box 14 supports the translucent top 16, which is generally square or rectangular. The rear edge 28 of the top 16 can be elevated as compared to the opposite and front edge 20, the rear edge 28 being approximately one-half to three inches higher than the front edge 30.

Figure 2:
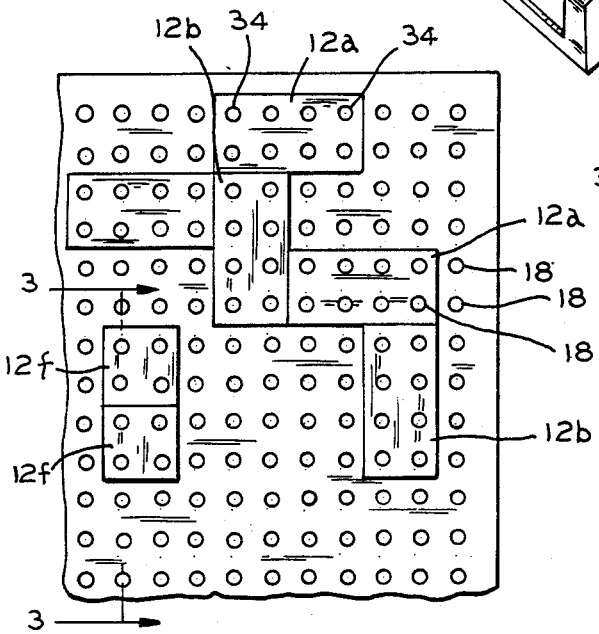
FIG. 2 is a plan view of a fragment of the top of the light box with a plurality of blocks laid thereon.

As best seen in FIG. 2, the translucent top 16 has a plurality of upstanding pegs 18 arranged in a uniform grid pattern for enabling a snap on attachment of blocks 12 thereto. The blocks may be fitted directly onto pegs 18 which project from the translucent top 16, with the blocks 12 extending either horizontally (as at 12a) or vertically (as at 12b). If desired, the entire surface of the translucent top 16 may be covered with the blocks. Additional blocks 12 may be added to and snapped on over the tops of the blocks 12, themselves.

Figure 3:
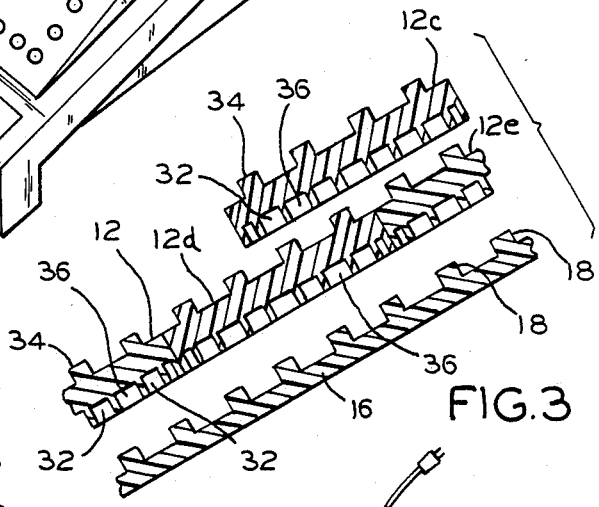
FIG. 3 is an exploded cross section view, partially taken along line 3—3 of FIG. 2, showing the top of the light box and four of the translucent blocks.

FIG. 3 shows a cross section with four of the blocks 12 and a fragment of the top 16 of the light box 16, and with the blocks slightly separated in an exploded view. In greater detail, the translucent top 16 has a plurality of upstanding pegs 18 each separated from its neighboring pegs by a uniform distance for snap over attachment of the blocks 12 which have complementary cylindrical sockets 32, also separated by the uniform distance. The pegs 18, located on the translucent top 16 are adapted to receive and fit into the hollowed out cylindrical sockets 32 which are located on the bottoms of the blocks 12. The sockets 32 are also adapted to receive the pegs 34 projecting from the tops of the translucent blocks 12 and thereby enable the child to securely attach and easily detach the blocks 12 from the top 16. The area 36 surrounding the cylindrical sockets 32 may also be hollow to save plastic. Since the top portion of the blocks also have a plurality of upstanding pegs which function the same as the upstanding pegs 18 which are located on the top of the light box 16, block **12*c* is shown as being poised to be attached to other blocks 12*d*, 12*e* in the same manner that any block 12 may be attached to the top of the light box 16. Thus, the blocks 12 may be stacked on top of each other in the same manner that they are attached to the translucent top 16**.

Generally, the drawing shows each block 12 as including approximately eight pegs 34 and approximately eight cylindrical sockets 32, the number of pegs corresponding to the number of cylindrical sockets. However, the blocks may have many different sizes and shapes, but the proportions are such that they all fit together. For example, blocks **12*f* are half size and have four pegs 34 and sockets 36**, while other blocks may have six or ten pegs and sockets.

When attaching one block 12 to another block 12, all or only some of the pegs 18 may be inserted into the cylindrical sockets 32. Thus, the blocks 12 may be attached to each other in an overlapping (either side or end) fashion. The blocks 12 may also be attached parallel or perpendicular to each other. In addition to being translucent or transparent, the blocks 12 may have various designs on them, for example, they could be pieces of a jigsaw puzzle.

Figure 4:
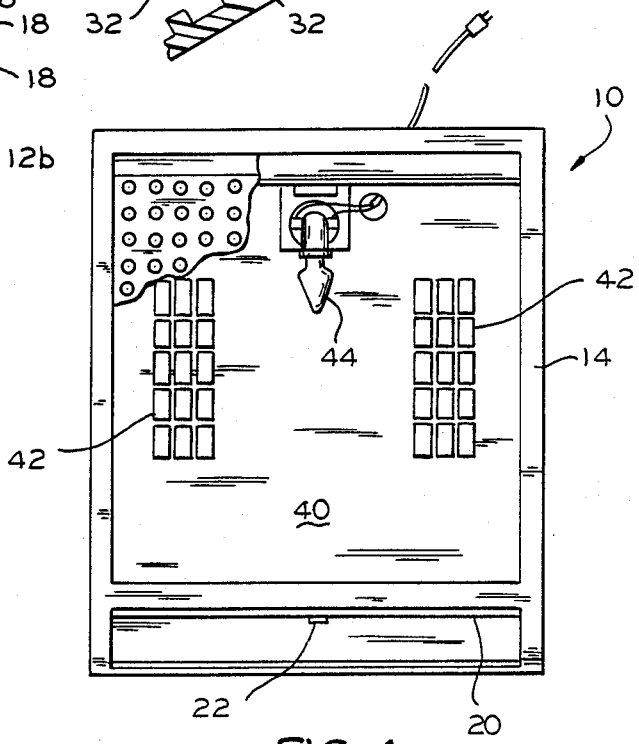
FIG. 4 is a plan view of the inventive light box, showing the top of the light box broken away to reveal the inside, and the bottom of the box.

FIG. 4 shows, in part, the interior of the assembly 10. The bottom panel 40 of light box 14 includes a plurality of air vents 42. There is no exact number or positioning required for these vents. The bottom 26 or one of the sides of the light box 14 houses a preferably low wattage bulb 44 which is connected to a power source via cord 24. In the alternative, flashlight batteries may be used to light the lamp 44. The on-off switch 22 controls the lighting of bulb 44.

While the invention has been described in relation to a preferred embodiment thereof, those skilled in the art may develop a wide variation of structural details without departing from the principles of the invention. Therefore, the appended claims are to be construed to cover all equivalents falling within the true scope and spirit of the invention.

The claimed invention is:

1. An electrically lighted construction toy comprising a light box, said box having a translucent top with a plurality of uniformly distributed upstanding pegs integrally formed thereon in a grid pattern, a plurality of blocks made of a light transmitting material and having sockets on one side and pegs integrally projecting from an opposite side, said sockets and pegs on said blocks and said pegs on said top being uniformly distributed to complement each other so that they may be plugged into each other, said sockets on said blocks being adapted to receive said pegs on said translucent top, said sockets on the blocks also being adapted to receive the pegs on other blocks, whereby said blocks may be stacked on each other to make three dimensional figures, and means inside said box for back lighting said translucent top whereby said translucent top and blocks thereon transmit light and wherein all electrical connections are encased within said light box.

2. The toy of claim 1 wherein said lighting means inside said box includes air vents, a low wattage bulb, and an on-off switch for controlling the lighting of said bulb.

3. The toy of claim 1 wherein said translucent top displays said blocks to a person who is sitting in front of the box.

4. The toy of claim 1 wherein said pegs on said top and said blocks enable said blocks to be oriented in different positions.

5. The toy of claim 4 wherein said blocks have sizes and shapes which are proportional to each other so that they may fit together in different patterns.

6. The toy of claim 5 wherein said pegs and sockets projecting from said blocks are adapted to fit into each other and said upstanding pegs of said translucent top regardless of the size and shape of said blocks.

7. A lighted construction toy comprising a light box having a removable, translucent top, said light box having a plurality of air vents and having therein a low wattage bulb and a switch for controlling a lighting of said bulb, said translucent top having a plurality of upstanding pegs integrally formed thereon in a grid pattern, a plurality of light transmitting plastic blocks having sockets on one side and pegs on the other side thereof, said sockets and pegs being distributed so that a plurality of said blocks may be attached to said top by pressing said sockets over said upstanding pegs on said translucent top and on said other blocks, said blocks having sizes and shapes which are proportional to each other so that they fit together when arranged in numerous structures and wherein all electrical connections are encased within said light box.

8. The toy of claim 7 wherein the top is inclined.

* * * * *